US012723852B2

(12) United States Patent
Leontev

(10) Patent No.: US 12,723,852 B2
(45) Date of Patent: Sep. 1, 2026

(54) SHOOTING RANGE

(71) Applicant: Sergei Nikolaevich Leontev, Rostov-on-Don (RU)

(72) Inventor: Sergei Nikolaevich Leontev, Rostov-on-Don (RU)

( * ) Notice: Subject to any disclaimer, the term of this patent is extended or adjusted under 35 U.S.C. 154(b) by 423 days.

(21) Appl. No.: 18/276,276

(22) PCT Filed: Nov. 26, 2021

(86) PCT No.: PCT/RU2021/050396
§ 371 (c)(1),
(2) Date: Aug. 8, 2023

(87) PCT Pub. No.: WO2022/177463
PCT Pub. Date: Aug. 25, 2022

(65) Prior Publication Data

US 2024/0125582 A1 Apr. 18, 2024

(30) Foreign Application Priority Data

Feb. 17, 2021 (RU) ..... RU2021103961

(51) Int. Cl.
*F41J 11/00* (2009.01)
*F41J 5/02* (2006.01)
*F41J 5/04* (2006.01)

(52) U.S. Cl.
CPC ..... *F41J 11/00* (2013.01); *F41J 5/02* (2013.01); *F41J 5/04* (2013.01)

(58) Field of Classification Search
CPC ..... F41J 5/02; F41J 5/04; F41J 11/00
See application file for complete search history.

(56) References Cited

U.S. PATENT DOCUMENTS 5,088,741 A * 2/1992 Simonetti ..... F41J 11/00 273/410
7,967,296 B1 * 6/2011 Halverson ..... F41J 11/00 273/404
10,048,046 B1 * 8/2018 Iliev ..... F41H 5/04
2019/0063884 A1 * 2/2019 McBride ..... F41J 5/10

FOREIGN PATENT DOCUMENTS

DE 202018103584 U1 * 9/2019 ..... F41J 5/14

* cited by examiner

*Primary Examiner* — Kyle R Grabowski
(74) *Attorney, Agent, or Firm* — Nadya Reingand

(57) ABSTRACT

The invention relates to high performance sport and can be used for carrying out training events and competitions. The technical result consists in the creation of a simple shooting range for developing and consolidating proper skills for combined running and shooting races using a laser pistol and laser targets. The present shooting range comprises a mobile modular disassemblable structure consisting of a firing line, a target line, and a system for video recording shots fired, wherein the firing line is configured from a set of individual modules joined to form a single linear structure and being a disassemblable modular structure consisting of a frame with a roof and protective side walls for each module, the side pieces of the frame being connected to one another by two cross-pieces arranged in two tiers.

8 Claims, 5 Drawing Sheets

SHOOTING RANGE

FIELD OF THE INVENTION

The invention relates to high-performance sport and can be used for training events and competitions at the All-Russian and International levels in the Olympic sport—the modern pentathlon in the form of laser-run according to the rules of the International Modern Pentathlon Union (UIPM) and according to the rules of the sport "modern pentathlon" which are approved by Order No. 6 of the Ministry of Sports of the Russian Federation dated Jan. 10, 2018. The invention relates to a movable sports facility—a modular dismountable iron structure having a roof and protective PVC side walls, with each module having double wooden tabletops (firing line) and iron racks which separately stand at a distance of 10 meters and are equipped with a background banner grid for placing electronic-laser targets (target line). The structure is equipped with a set of original external reserve LED lights having a protective visor from the sun and rain, an autonomous camera and a laptop having software at each shooting station to determine and record a value of hit. The firing line can be used in all weather conditions, year-round and around the clock.

BACKGROUND OF THE INVENTION

RU 185483 (Mar. 21, 2018) discloses a shooting range called "target installation". This range comprises a target installation located on the same frame with battery, including light indication implemented based on LEDs connected to an antenna arranged on an installation pin. The equipment is designed to use the principle of individual control of the target installation over a radio channel according to an equipment-specific protocol for the exchange of information between a control panel and the target installation. The shields of the target installations are equipped with devices for simulating real thermal signatures of targets controlled via the radio channel. This shooting range has a number of disadvantages associated with the impossibility of its use in the conditions of the modern pentathlon competitions and training for them.

DE 102008051376 A (Oct. 15, 2008) discloses a shooting range called "sport firing range". It comprises a biathlon shooting range with at least one piece of sports equipment for a shooter and at least one target that can be selected in a gunsight. A shot is fired by a laser beam, preferably in the visible range from the sports equipment, and a sensor for detecting the laser beam is provided for each target. The laser beam for transmitting data from the sports equipment is modulated into a block, while a unique identifier of the sports equipment is transmitted. The data is transmitted repeatedly and sequentially in blocks during one shot. The modulated laser beam can be transmitted during a frame alternately. This shooting range has a number of disadvantages associated with the impossibility of its use in the conditions of the modern pentathlon competitions and training for them, as well as the lack of protection of an athlete from the effects of external adverse factors.

U.S. Ser. No. 10/048,046 (Oct. 26, 2016) discloses a shooting range called "shooting range booth assembly". It comprises at least a pair of upwardly extending spaced apart multi-ply walls, and a frame element comprising at least one support stringer for attaching to and supporting said walls in upright positions. Each of said walls has a frame and inner panels connected to said frame, as well as outer ballistic resistant plates affixed to an outer surface of said inner panels. Said outer ballistic resistant plates further comprise interlineated layers of modified polyethylene materials and layers of carbon nanotubes between adjacent modified polyethylene material layers. Each said interlineated layer of modified polyethylene material is formed having a molecularly oriented layer of material. This shooting range has a number of disadvantages associated with the impossibility of its use in the conditions of the modern pentathlon competitions and training for them, as well as the lack of protection of an athlete from the effects of external adverse factors and the expensive design of the shooting range.

SUMMARY OF THE INVENTION

It is an object of the invention to create a shooting range for high-performance sport, which complies with the rules and requirements of the UIPM. It is a further object of the invention to create the shooting range that does not suffer from the disadvantages of the prior art solutions, as well as is suitable for practicing shooting skills in a training process and carrying out the modern pentathlon competitions. The technical result to be achieved by using the invention consists in creating the shooting range that ensures the development and consolidation of the "correct" skills of high-speed shooting, combined with running, from a laser pistol at laser targets. This technical result is achieved by the whole set of essential features.

BRIEF DESCRIPTION OF THE DRAWINGS

The invention is explained by the drawings in which.

DETAILED DESCRIPTION OF THE INVENTION

Figure 1:
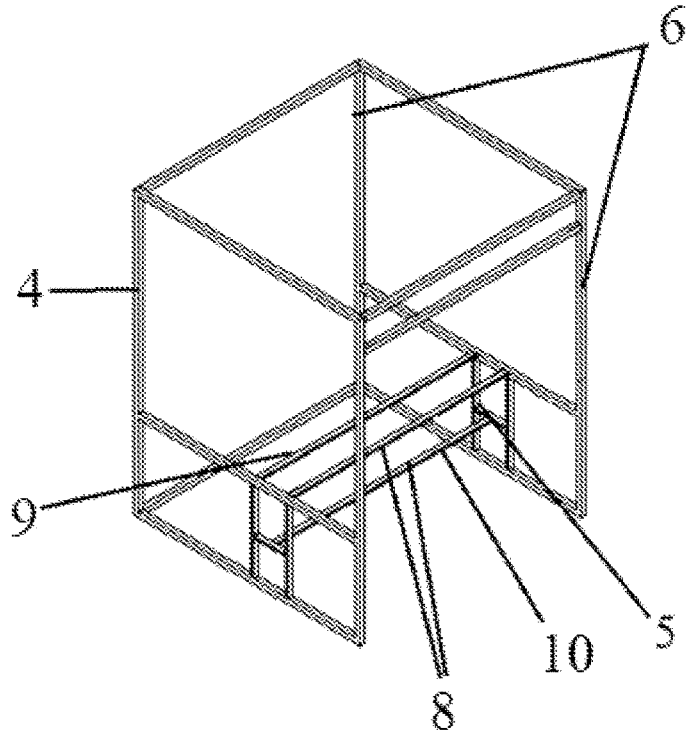
FIG. 1 shows the frame of a shooting range in assembled form.
Figure 2:
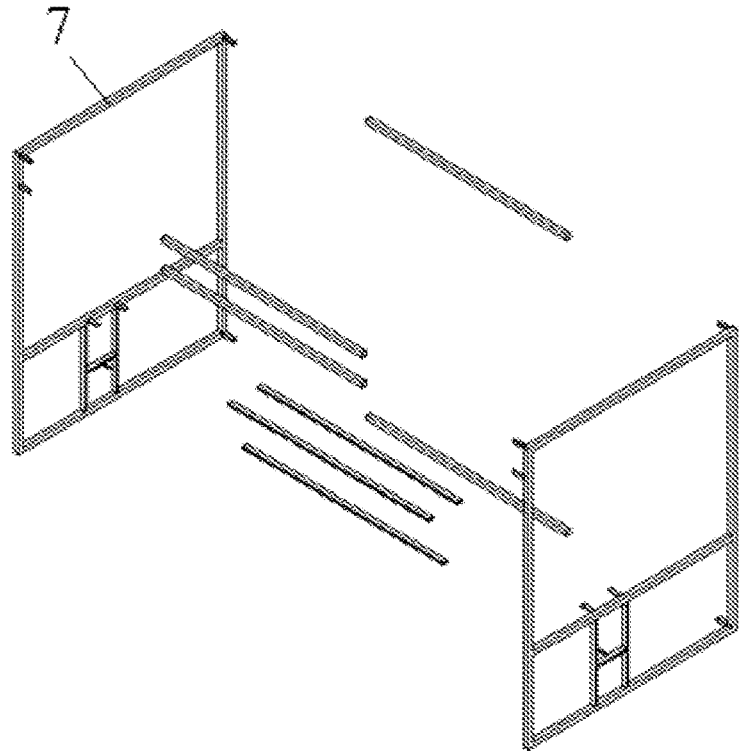
FIG. 2 shows the frame of the shooting range in disassembled form.
Figure 3:
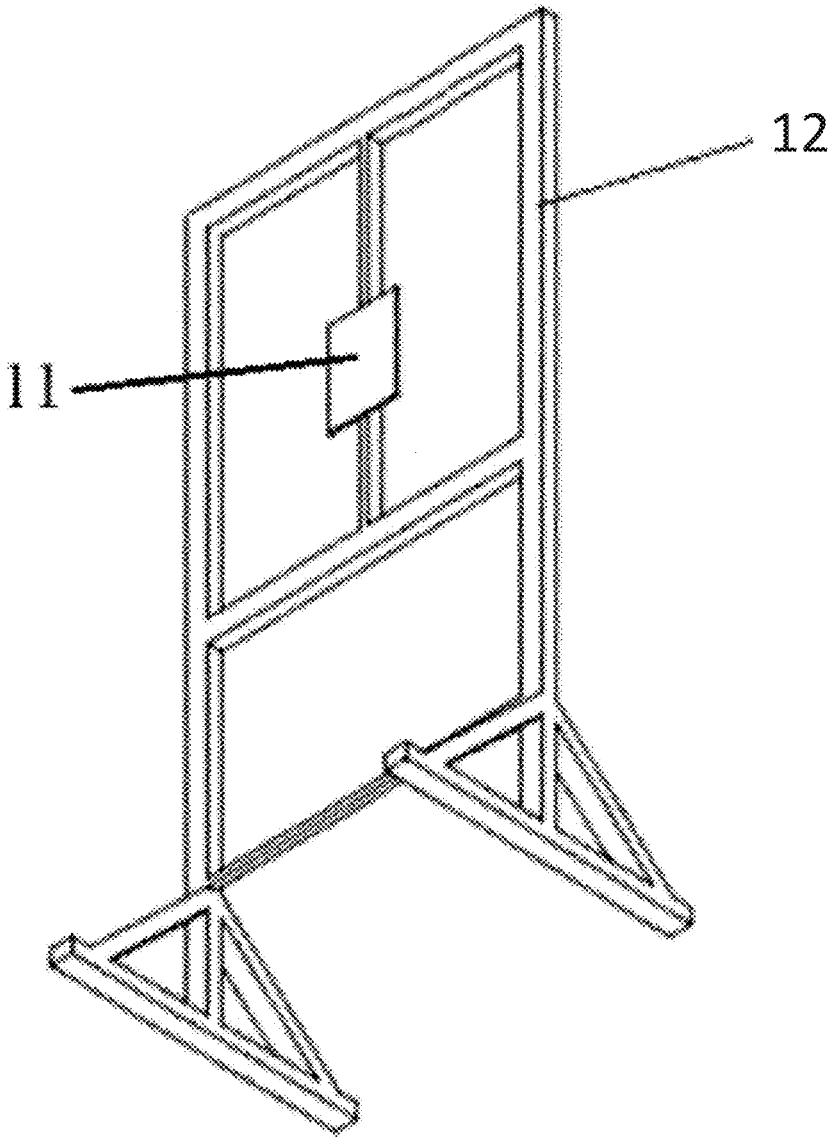
FIG. 3 shows a line of targets.
Figure 4:
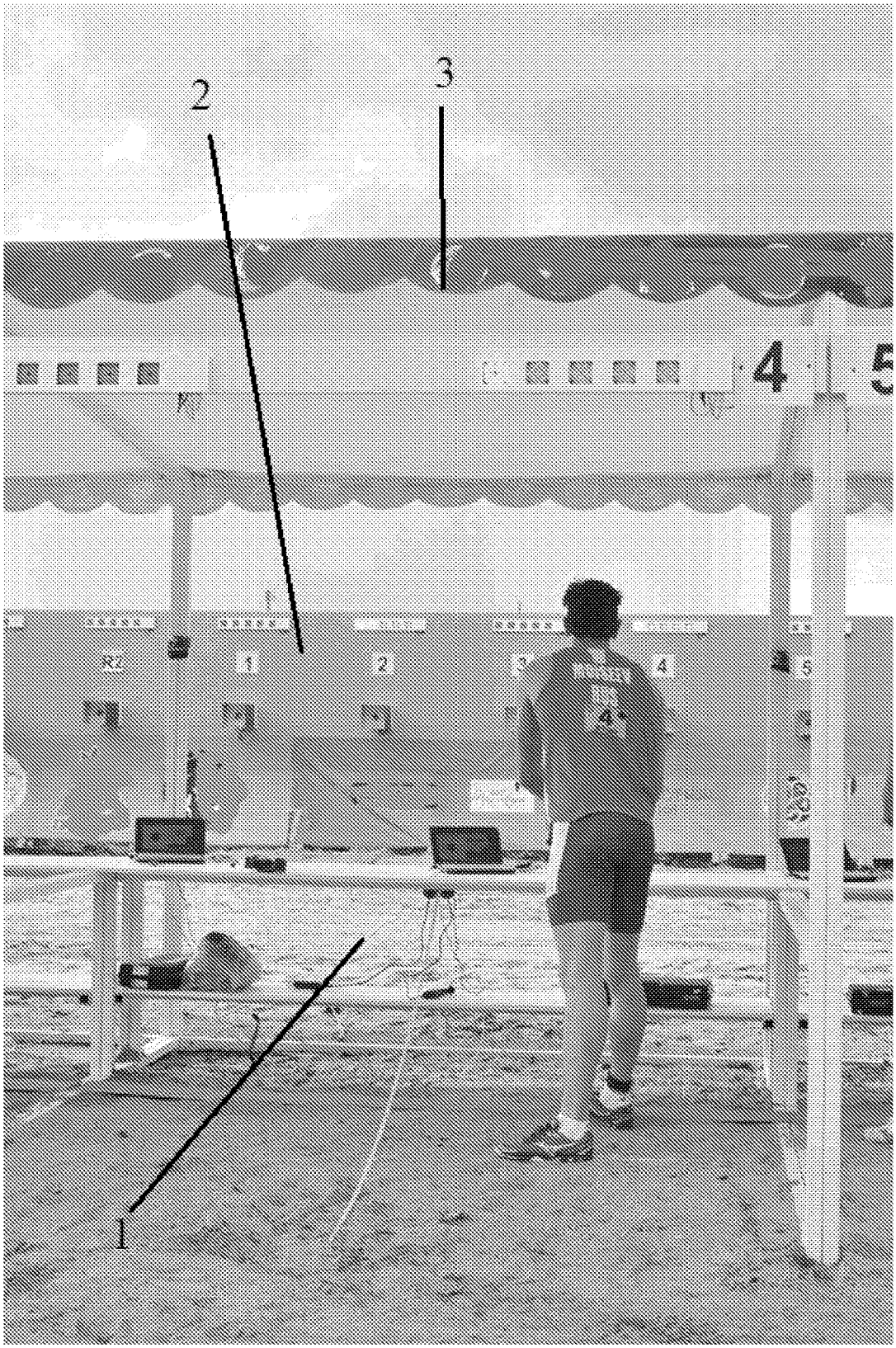
FIG. 4 shows the shooting range.
Figure 5:
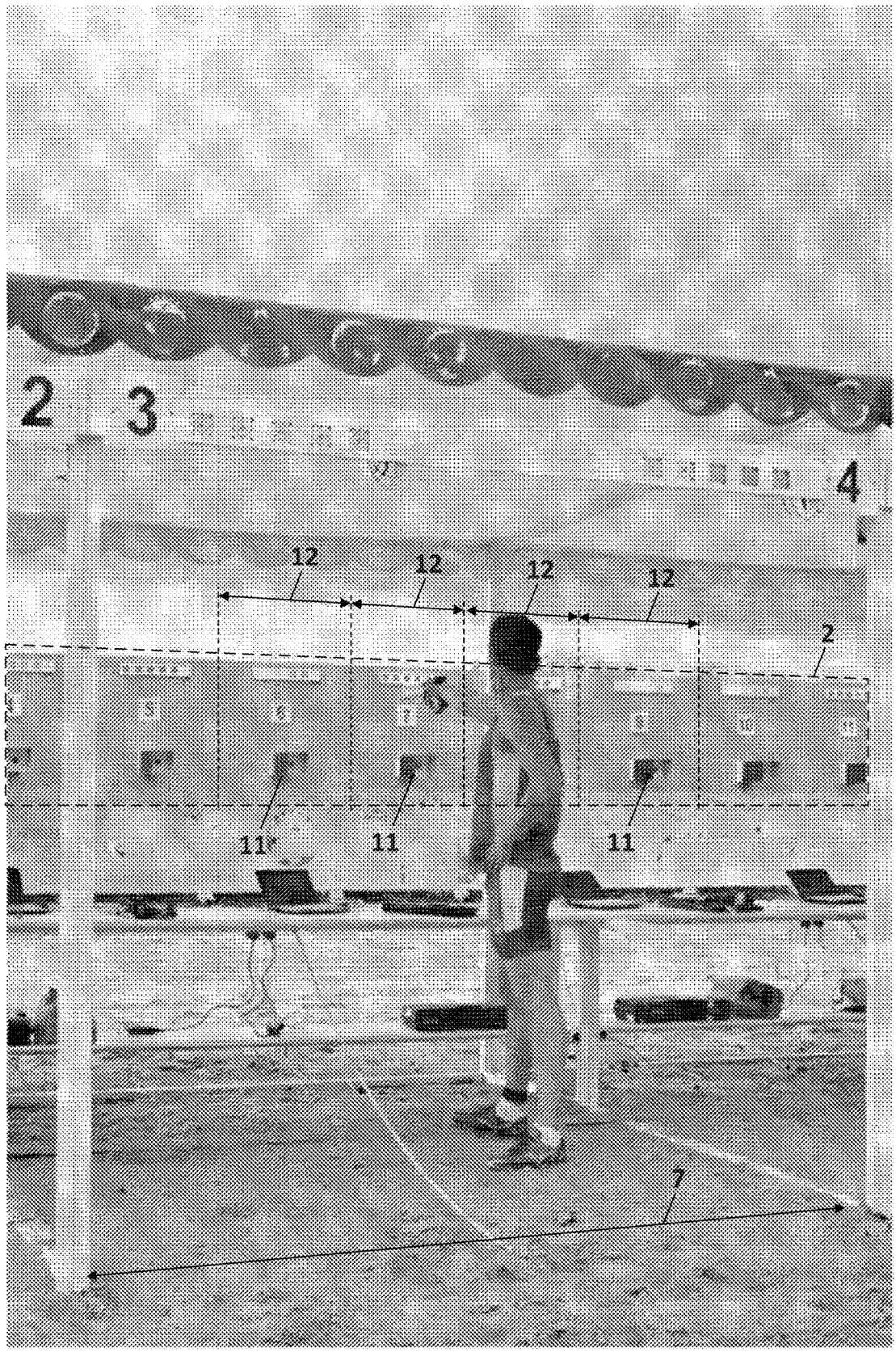
FIG. 5 shows the shooting range.
Figure 6:
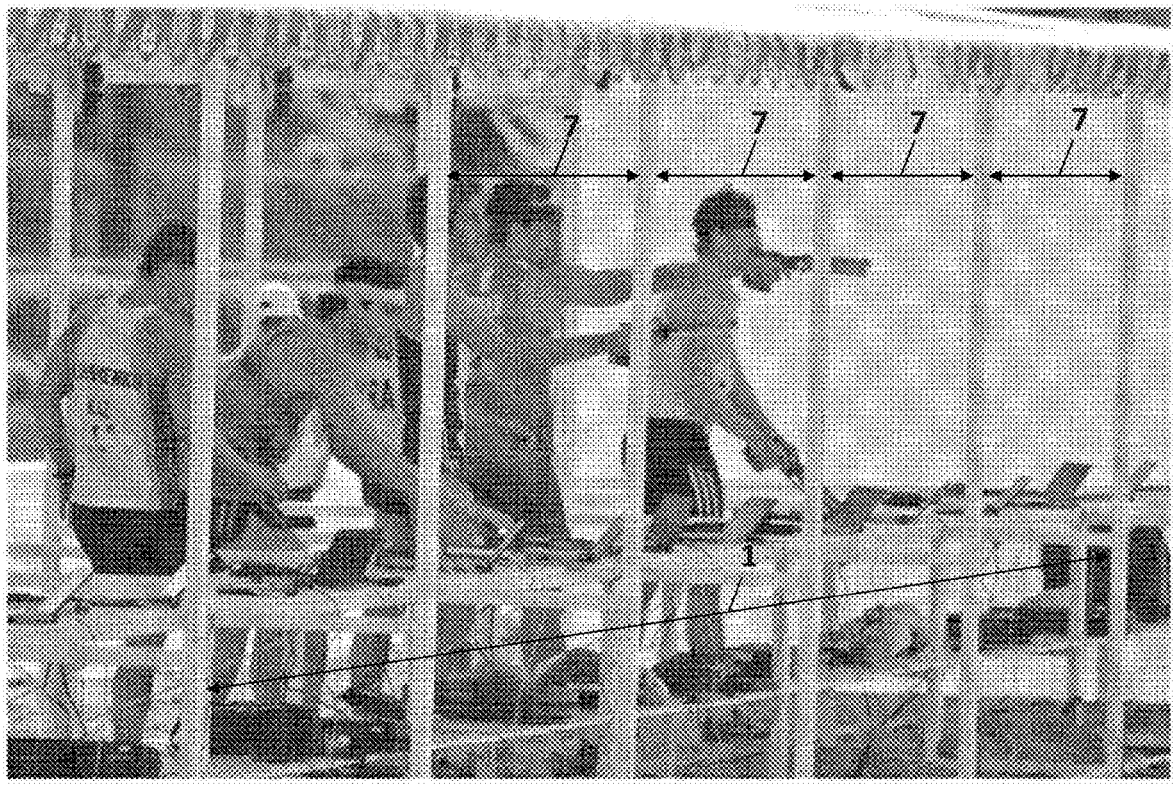
FIG. 6 shows the shooting range.
Figure 7:
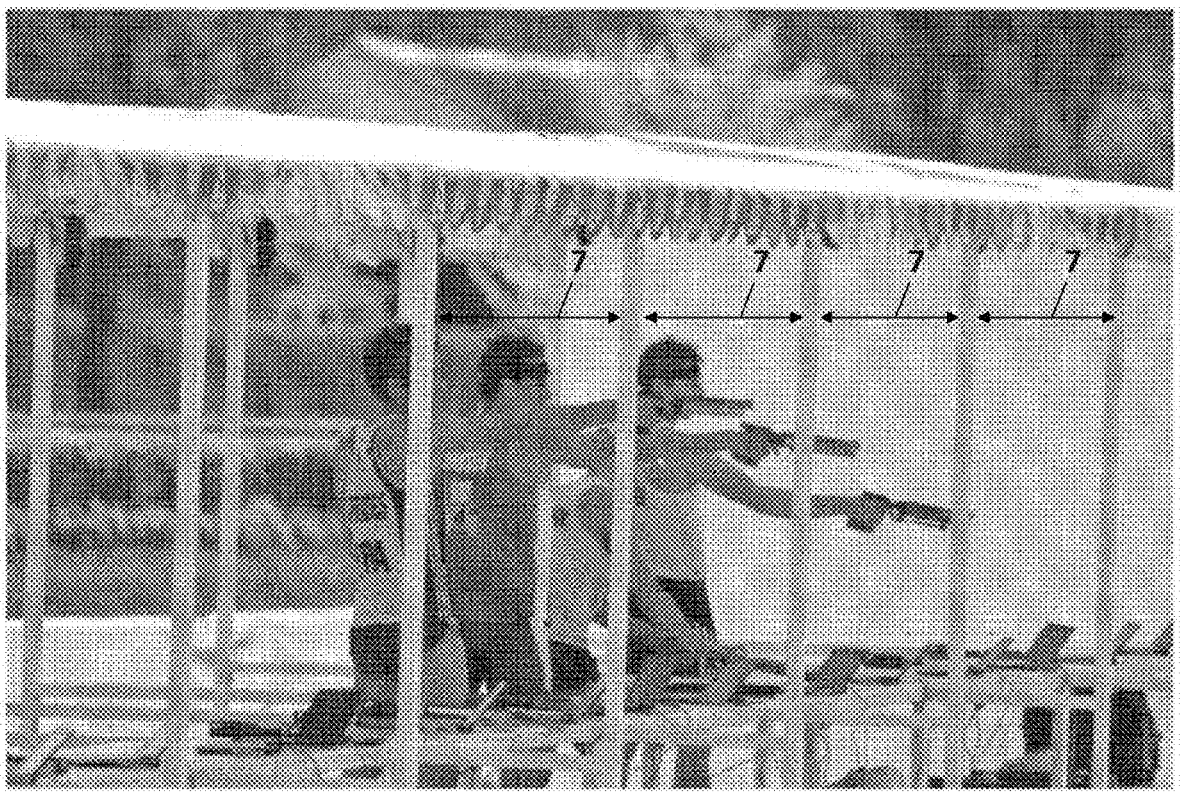
FIG. 7 shows the shooting range.

The essence of the invention lies in the fact that a shooting range comprises a mobile modular dismountable structure comprising a firing line, a line of targets and a shot video-recording system. The firing line is made of a set of individual modules assembled into a single linear structure, which is a dismountable modular structure comprising a frame having a roof and protective side walls in each module. The side walls of the frame are interconnected by two crossbars arranged in two tiers, on which two tiers of upper and lower shelves are fixed to form a tabletop. The line of targets is provided opposite to the firing line and is configured as individual vertical racks assembled into a single linear structure to form the frame, with a center of gravity shifted downwards and attachment points for placing a laser target. The shot video-recording system is configured to record the entire set of movements of a pentathlete when performing a shooting series. The shot video-recording system comprises video cameras arranged in in the upper right and upper left corners of the frame of the module of the firing line on the rack of the line of targets at the top center, as well as an electronic target and a computer which are arranged in the module of the firing line and allow a value of hit to be recorded. The elements of the shot video-recording system are interconnected by wire and/or wirelessly. At the same time, the module of the firing line is designed for at least two shooting places. Furthermore, the frame is made of iron and/or aluminum and/or carbon fiber. The roof is a tent covering made of PVC or textiles and awning curtains. In addition, protective partitions made of transparent material are provided on the sides of the roof. At the same time, the tiers of the shelves are made of laminated chipboard and/or solid wood and/or plastic sheets. In addition, the laser targets are equipped with LED lights for hit/miss fixation. The firing line is equipped with external reserve lights and/or a background banner grid. Furthermore, the frame of the firing line is made of iron and/or aluminum and/or carbon fiber. At the same time, the line of targets is equipped with a laser target of Hit&Miss type (hit/miss) with software. The line of targets is equipped with a laser target of Hit&Miss or Hit&Miss Connect type with software.

The shooting range is a movable sports facility-a modular dismountable structure comprising a firing line 1, a target line 2, a roof 3, protective side walls (not shown in the figures), a tabletop 5, a shot video-recording system. The firing line 1 comprises a set of individual modules 7 assembled into a single linear structure. The module 7 of the firing line 1 is a dismountable modular iron structure of the firing line for at least two shooting places and is intended for simultaneous firing by no more than two athletes. One module 7 comprises a dismountable structure—a frame 4 made of durable materials, for example, iron, aluminum, carbon fiber, with the roof 3 and the protective side walls (not shown in the figures) for each module 7. The protective side walls (not shown in the figures) are designed to form an isolated space that protects an athlete from the effects of external adverse factors, allows the athlete not to see and, accordingly, not be distracted by the actions of competitors firing nearby. The roof 3 is stretched on top of the frame 4. The roof 3 is a tent covering made of PVC or textile and awning curtains. An advertising image can be applied on the awning curtains. The roof 3 is designed to protect the athletes, in the process of firing a shot, from the negative effects of the environment: precipitation, sunlight, etc. On the sides of the roof 3, there are protective partitions made of a transparent material, such as PVC. The frame 4 has sidewalls 6 interconnected by two crossbars 8 arranged in two tiers, on which two tiers of upper 9 and lower 10 shelves are fixed to form the tabletop 5. The tiers of the shelves 9 and 10 can be made of laminated chipboard, solid wood, plastic sheets. Bolts and nuts are used as fastening means. The tier of the upper shelves 9 is designed to accommodate sports equipment—a laser pistol. During training events and competitions at the pre-start warm-up of the competitors, as well as when pentathletes run along the route of the laser-run distance, the laser pistol is always on the upper shelf 9 of the firing line 1 in the module 7. When shooting from the laser pistol at laser targets 11, the upper shelf 9 of the firing line 1 in the module 7 serves as a limiter when the athlete moves forward to maintain a minimum allowable shooting distance (at least 10 meters) to the line 2 of targets in accordance with the UIPM rules for conducting competitions. The upper shelf 9 serves as a limiter for the downward movement of the arm with the weapon of the pentathlete performing the shooting. The lower shelf 10 is designed to accommodate a case (casing, box) with a set of tools for setting up laser systems from the main pistol used by the athlete when shooting during training events, at pre-start warm-up and competitions, as well as a spare set of a pistol, a target and other sports equipment permitted by the competition rules.

The line 2 of targets is made in the form of iron racks 12 on which the laser targets 11 are placed. The laser targets 11 are equipped with LED lights for hit/miss fixation. The line 2 of targets comprises a set of individual vertical racks 12 assembled into a single linear structure for mounting the laser targets 11 of the shooting range. One rack 12 of the line 2 of targets in the shooting range is designed to accommodate one laser target 11. One rack 12 of the line 2 of targets in the shooting range comprises a solid structure (frame) made of durable materials, for example, iron or aluminum, or carbon fiber, with a center of gravity shifted downwards and attachment points for placing the laser target 11, external reserve lights, a background banner grid. The shot video-recording system is configured to record the entire set of movements of a pentathlete when performing a shooting series: preparing for a shot, firing the shot, and performing actions after the shot has been fired throughout the shooting series (5 shots or more), after the start of a running distance, as well as for adjusting further shooting. From the video one can see whether the pentathlete performs the run and the grip of a weapon (pistol) technically correct or not, monitor the correct position of his/her legs, body, extension and trajectory of raising the hand with the weapon, the position of another free hand without the weapon, head movements, the tension of the body muscles, as well as fix an aiming point, the trajectory of moving the hand with the weapon to the aiming point, and then to the target. The measure for this is the accuracy and speed of fire-five hits on the target in the shortest time. To do this, each double shooting module 7, designed for shooting by two athletes, is equipped with two cameras in the upper right and upper left corner of the frame 4. These cameras shoot and show the top, front and side views of both pentathletes. Each rack 12 of the line 2 of targets, on which the shooting target 11 is placed, is equipped in the top center (on the upper bar) with a camera that shoots and shows the view from a distance of 10 meters in the frontal position of the athlete, the view of raising the hand with the weapon, the moment of aiming and the correctness of the trajectory of raising the hand with the weapon (straight, no zigzags). Each personal place of the pentathlete at the firing line 1 and the line 2 of targets of the shooting range (20 places in total) is equipped with the electronic target 11 and a computer—a laptop with software that allows recording the value of a shot. Even though the target 11 itself, i.e., its scoring part in the form of a black circle, is not marked by the value of the shots (by analogy with biathlon), special software allows the pentathlete to see the value of the shot fired at the scale of 5 to 10 points on the laptop monitor (everything beyond 5 corresponds to 0). The electronic target 11 and the computer and/or the external cameras can be interconnected both by wire and wirelessly. In the shot video-recording system at the firing line, 2 types of targets are used. The first type of targets 11 is a laser target for the modern pentathlon and laser-run of "Hit&Miss" type (hit/miss) with software. These targets 11 are designed for primary training, further training, and competition in laser shooting in the modern pentathlon and laser-run. The main operational principle of the target 11 is that it evaluates the hit of a laser beam in effective zones. The effective zone, in turn, consists of a hit zone and a miss zone. A green LED is used to signal a positive result, i.e., HIT, while a glowing red LED is used to signal a negative result—MISS. The operational principle of the software is as follows: this target is connected to the laptop using a USB cable, and all shooting results are transmitted to the laptop for further processing. These targets 11 can be comprise special demonstration lamps for entertainment. The second type of targets 11 is a new "Hit&Miss Connect" target from the Czech company "Pentashot", which is intended for briefings, trainings and the All-Russian and international level competitions. Using this target 11, the pentathlete can easily monitor the results of his/her shooting on a smartphone. The software is available for both Android and iOS. The target 11 meets the requirements of the International Union of Modern Pentathlon. Its parameters are as follows: 270×190×32 mm. The weight of the target 11, including batteries, is 684 grams. Its operating temperature is 10-50° C. Its affected area is ø 59.9 mm. Its missing zone: 180 mm×175 mm. Its laser encoding types is UIPM 15.6 ms or 25.2 ms. The operational principle of the software consists in using wireless data transmission—Bluetooth (target×smartphone, tablet or laptop). The target is produced by the Czech Republic. These targets can comprises the special demonstration lamps for entertainment. To improve the visibility of the shooting results (i.e., the activation of the green or red LED), all-weather external electric lights duplicating the target 11 are installed over the targets 11. These electric lights can be seen at a distance of at least 200 meters for spectators present in the stands and outside a running track. The design is equipped with a set of original external reserve LED lights with a sun- and rain-protective visor, an autonomous camera, and a laptop with software at each shooting place to fix and record the value of shots.

The shooting range is used as follows. Laser-run is one of the types of the modern pentathlon, which includes running combined with shooting from a laser pistol at the laser targets 11. A pentathlete must overcome a running distance of 4×800 meters, and only 3200 (three thousand two hundred) meters and, during the running distance, make 4 (four) runs to the shooting range to complete 4 shooting series. Shooting at the laser targets 11 is carried out from a distance of 10 meters. It is this distance that separates the firing line 1 and the line 2 of targets of the shooting range. The goal is to hit the scoring part of the laser target 11 as quickly as possible with the laser pistol. Green light turns on in case of a hit, and red light turns on in case of a miss. Five LED lights are arranged directly on the laser target 11. For one run to the firing line 1 of the shooting range (one shooting series), the pentathlete must achieve 5 hits on the laser target 11, and until this moment he/she cannot leave the firing line 1. The number of shots is not limited. At the same time, the pentathlete can stay on the firing line 1 for no more than 50 seconds. The laser pistol of the athlete participating in a training event or competition is always located on the upper tier of shelves 9 of the firing line 1 and is not taken with him/her to the running distance. After the start of the run, the participant of the training event or competition runs to his/her place of the firing line 1 according to his/her start number indicated in the competition protocol and begins to execute the shooting series. Having made five hits in the scoring part of the target 11 (i.e., the black circle), the pentathlete may continue the running distance. The execution of one shooting series is limited by time—50 (fifty) seconds, upon the expiry of which the target 11 is automatically turned off. An athlete who could not make five hits in the scoring part of the target 11 upon the expiry of 50 (fifty) seconds is directed by a referee present at the firing line 1 to the running distance. Having made 5 hits in the scoring part of the target 11 or after 50 (fifty) seconds, the pentathlete goes to the running distance of 800 (eight hundred) meters. Having overcome the running distance of 800 (eight hundred) meters, the pentathlete again runs to the shooting range and, accordingly, performs the next shooting series, and so on. The modern pentathlon of "laser-run" type is associated with great physical exertion for pentathletes. The high-speed run for an average distance of 3200 (three thousand two hundred) meters is interrupted by stops—runs to the shooting range to perform pistol shooting. By the time the pentathlete starts making the first shot, his/her pulse can reach 190-195 beats per minute. This factor has a significant impact on the technique and quality of shooting, the speed and accuracy of the shot. Shooting from the laser pistol has its own specifics. For example, unlike a biathlete shooting from a sports rifle in a standing position, the pentathlete shooting in the standing position with the pistol does not have additional points of support for high-quality aiming and making an accurate shot using his/her free hand (which does not participate when pressing a trigger) as a support for the rifle from below and his/her shoulder as a rest for the rifle butt, which largely stabilizes the position of the shooter at the time of shooting, makes the aiming process more stable and the shot itself more accurate. Accordingly, it is much more difficult for the pentathlete to develop and consolidate the skill of shooting from the pistol in the modern pentathlon of "laser-run" type than in the biathlete or shooter who performs static shooting not combined with running (smooth running or skiing). With an increase in the load of the pentathlete during the passage of the modern pentathlon of "laser-run" type, especially in the second half and at the finish of the distance on the 3rd and 4th runs to the shooting range, the reproduction of conscious, technically "correct" shots becomes especially relevant when performing shooting series. Since the body of the pentathlete is tired by this moment due to the influence of high loads, his/her motor functions, nervous and muscle reactions become worse, for which reason shooting can be unstable. At this moment, the athlete begins to react to any external factors unfavorable for shooting. In this case, it becomes much more difficult for the athlete to achieve high results in laser-run and in the overall standings of the modern pentathlon competitions. Performing a technically "correct" shot is especially important, at the initial stage of training of pentathletes, in the formation and consolidation of shooting skills, which in the future will allow them to fight for high places in the high-performance sport. The "correct" grip of the pistol grip, the correct work of strictly defined muscle groups when moving the pistol into the target area on the visual line of sight, the even lifting of the pistol (without zigzags) along the shortest trajectory to the center of the target when moving the hand with the weapon, correct aiming, smooth work with a finger when pressing on the trigger with simultaneous control of the front sight in the slot of an aiming bar and the target and, accordingly, as the result of this work, a well-aimed shot with a hit in the scoring part (black circle) of the target can only be developed by repeating a large number of "correct" movements during training events and competitions without distraction to external factors. It is possible to achieve high-quality shooting and the best sports results in the modern pentathlon of "laser-run" type with the help of sports equipment, such as the shooting range having a modular design which protects athletes during shooting from the effects of external factors, i.e., rain, wind, dust, direct sunlight or artificial lighting from the front and on the side, thereby allowing the athletes not to see and, accordingly, not be distracted by the actions of competitors shooting nearby. During training events and competitions, a pentathlete, running into the module 7 of the shooting range, finds himself/herself in an isolated space that protects him/her from the effects of external adverse factors. Being in improved, more comfortable conditions than in open areas, the pentathlete at the time of preparing for the execution of a shooting series, at the time of shooting (i.e., pointing the weapon at the target 11, aiming and shooting) can generate and perform "correct" (in nature and trajectories of movement) actions aimed at performing the least time-consuming (i.e., the fastest and most accurate) shot and, accordingly, the minimum number of shots in the shooting series to complete it for 5 (five) shots-5 (five) hits in the scoring part of the target 11 (i.e., the black circle), in order to continue the running distance as soon as possible.

INDUSTRIAL APPLICABILITY

The present sports facility, i.e., the shooting range, is used for training events and competitions at the All-Russian and International level in the Olympic sport, namely in the modern pentathlon of "laser-run" type, according to the UIPM rules. The shooting range is a movable sports facility; it can be placed both outdoors and indoors. The shooting range can be designed when constructing a new sports facility, for example, an athletics stadium, or installed on the territory of an existing stadium or hippodrome. The shooting range can be installed and operate autonomously in open areas within the city, rural settlement, in the field, within the coastline of the sea, river, reservoir without being tied to a sports facility. The shooting range can be used in all-weather conditions of the temperate climate zone, all year round and around the clock. The shooting range comprising 20 modules corresponds to the standard of the modern pentathlon competitions in the form of the "laser-run" program of the Olympic Games. In this case, its design is suitable for the start of 36 pentathletes in one race according to the "handicap" system+4 spare shooting places.

The invention claimed is:

1. A shooting range comprising:

a mobile modular dismountable structure comprising a firing line, a line of targets and a shot video-recording system;

wherein the firing line is made of a set of individual modules assembled into a single linear structure, each module of the set of individual modules comprising a frame having a roof and protective side walls;

wherein the protective side walls of the frame are interconnected by two crossbars arranged in two tiers, on which two tiers of upper and lower shelves are fixed to form a tabletop;

wherein the line of targets is provided opposite to the firing line and is configured as individual vertical racks assembled into a single linear structure, each of the individual vertical racks comprising attachment points for placing an electronic target;

wherein the shot video-recording system is configured to record an entire set of movements of a pentathlete performing a shooting series, the entire set of movements comprising: preparing for a shot, firing the shot, and performing actions after the shot has been fired throughout the shooting series, after the start of a running distance, as well as for adjusting further shooting;

wherein the shot video-recording system comprises video cameras arranged in upper right and upper left corners of the frame of each module of the set of individual modules of the firing line and on each of the individual vertical racks of the line of targets at a top center, as well as the electronic targets and a computer which is arranged in each module of the set of individual modules of the firing line and configured to record a value of hit;

wherein the elements of the shot video-recording system are interconnected by wire and/or wirelessly.

2. The shooting range of claim 1, wherein the shooting range complies with the International Modern Pentathlon Union (UIPM) requirements for laser-run and the rules of the sport "modern pentathlon" which are approved by order No. 6 of the Ministry of Sports of the Russian Federation dated Jan. 10, 2018.

3. The shooting range of claim 1, wherein each module of the set of individual modules of the firing line is designed for at least two shooting places.

4. The shooting range of claim 1, wherein the frame is made of iron and/or aluminum and/or carbon fiber.

5. The shooting range of claim 1, wherein the two tiers of the upper and lower shelves are made of laminated chipboard and/or solid wood and/or plastic sheets.

6. The shooting range of claim 1, wherein the electronic targets are equipped with LED lights for hit/miss fixation.

7. The shooting range of claim 1, wherein the electronic targets comprise laser targets of Hit&Miss type (hit/miss) with software.

8. The shooting range of claim 1, wherein the electronic targets comprise laser targets of Hit&Miss or Hit&Miss Connect type with software.

* * * * *